US008667984B2

(12) United States Patent
Kobayashi et al.

(10) Patent No.: US 8,667,984 B2
(45) Date of Patent: Mar. 11, 2014

(54) EXPANSION VALVE

(75) Inventors: Kazuto Kobayashi, Tokyo (JP); Takashi Mogi, Tokyo (JP)

(73) Assignee: Fujikoki Corporation, Tokyo (JP)

( * ) Notice: Subject to any disclaimer, the term of this patent is extended or adjusted under 35 U.S.C. 154(b) by 189 days.

(21) Appl. No.: 13/343,987

(22) Filed: Jan. 5, 2012

(65) Prior Publication Data

US 2012/0192970 A1 Aug. 2, 2012

(30) Foreign Application Priority Data

Jan. 31, 2011 (JP) ..... 2011-017967

(51) Int. Cl.
*F16K 17/38* (2006.01)
*F25B 41/06* (2006.01)

(52) U.S. Cl.
CPC ..... *F25B 41/062* (2013.01)
USPC ..... 137/468; 236/92 B

(58) Field of Classification Search
CPC ..... F16K 27/02; F25B 41/062; F25B 2341/0683; F25B 2500/32
USPC ..... 251/61.2, 331, 335.2; 236/92 B; 137/505.18, 78.1, 468
See application file for complete search history.

(56) References Cited

U.S. PATENT DOCUMENTS

| | | | | | |
|---|---|---|---|---|---|
| 3,810,366 | A * | 5/1974 | Orth | 62/217 |
| 6,092,733 | A * | 7/2000 | Watanabe et al. | 236/92 B |
| D429,315 | S * | 8/2000 | Okada et al. | D23/233 |
| 6,412,703 | B2 * | 7/2002 | Yano et al. | 236/92 B |
| 6,626,370 | B2 * | 9/2003 | Yano et al. | 236/92 B |
| 6,889,909 | B2 * | 5/2005 | Kobayashi et al. | 236/92 B |
| D601,662 | S * | 10/2009 | Kobayashi et al. | D23/233 |
| D647,597 | S * | 10/2011 | Kobayashi et al. | D23/233 |
| 2001/0032886 | A1 * | 10/2001 | Yano et al. | 236/92 B |
| 2004/0026524 | A1 * | 2/2004 | Yano et al. | 236/92 B |
| 2006/0117774 | A1 * | 6/2006 | Ise et al. | 62/222 |
| 2006/0196201 | A1 * | 9/2006 | Sendo et al. | 62/222 |
| 2010/0237270 | A1 * | 9/2010 | Kobayashi et al. | 251/331 |

FOREIGN PATENT DOCUMENTS

WO WO 2009054211 A1 * 4/2009

* cited by examiner

*Primary Examiner* — Craig Schneider
*Assistant Examiner* — Jessica Cahill
(74) *Attorney, Agent, or Firm* — Bacon & Thomas, PLLC

(57) ABSTRACT

To reduce a weight of a valve main body of an expansion valve formed by an extrusion molding of a metal material such as an aluminum alloy or the like. A valve main body 100 is made of a material obtained by an extrusion molding of a metal material such as an aluminum alloy or the like. Two pair of holding faces 101*a* and 101*b*, and 102*a* and 102*b* are formed on both side face 100*a* and 100*b* in the extruding direction of the valve main body 100, and the other portions are to be concave as much as possible, so that the weight can be reduced. The holding faces 101*a* and 101*b* and the holding faces 102*a* and 102*b* are parallel faces, and come to be holding faces for chuck claws $C_1$ and $C_2$ at a time of machining.

3 Claims, 6 Drawing Sheets

EXPANSION VALVE

BACKGROUND OF THE INVENTION

1. Field of the Invention

The present invention relates to an expansion valve used in a refrigerant cycle.

2. Description of the Conventional Art

A valve main body of an expansion valve used in a refrigerant cycle for a vehicle air conditioner or the like is produced by machining a material which is obtained by an extrusion molding of a metal material such an aluminum alloy or the like.

Japanese Patent Application Laid-Open No. 2002-206134 discloses an expansion valve having such a kind of the valve main body.

SUMMARY OF THE INVENTION

Since the valve main body of the expansion valve uses a material proper for an extrusion molding, such as an aluminum alloy or the like, the valve main body is appropriate for requirement for weight saving in light of its material. However, further weight saving has been required due to requirements for saving energy of the air conditioner, reducing load to an environment, and the like. In a production process of the valve main body of the expansion valve, a long material is produced by an extrusion molding of an aluminum alloy or the like at first, and then the long material is cut to obtain a material to be machined. The obtained material is a roughly hexahedral prismatic. Four faces of the prismatic are machined, and the remaining two faces are used as a face for chucking at a time of machining.

The present invention focuses on the structure of the aforementioned valve main body, and has an objective to provide an expansion valve enabling to realize further weight saving.

According to an aspect of an expansion valve of the present invention, the expansion valve includes a valve main body, a valve body, and a power element. The valve main body has a first passage, in which a high-pressure refrigerant passes from a condenser to an evaporator, an orifice provided at a middle of the first passage and for reducing pressure of the high-pressure refrigerant, and a second passage, in which a low-pressure refrigerant passes from the evaporator to the condenser. The valve body performs opening/closing of the orifice. The power element drives the valve body based on a temperature and a pressure on the outlet side of the evaporator. The valve main body is formed by the extrusion molding. In a state that the both side faces in the extruding direction of the valve main body are held in the orthogonal direction to the extruding direction by a chuck mechanism, a face intersecting the both side faces is machined, so that the first passage, the second passage, the orifice and attaching hole of the power element are formed. The both side faces have a pair of holding faces held by the chuck mechanism. In addition, portions other than the holding faces are formed to have concave parts which are concave more on the inner side than the holding faces, and the holding faces and the concave parts are formed at a time of the extrusion molding.

In one example, the concave parts along a peripheral face of the second passage are formed on both sides in the axial direction of the second passage, and the pair of the holding faces is formed on the upper and lower sides of the concave part.

In another example, the concave parts along a peripheral face of the first passage are formed on both sides in the axial direction of the first passage, and the pair of the holding faces is formed on the upper and lower sides of the concave part.

In the expansion valve according to the present invention, when the material of the valve main body is produced by the cold-extrusion molding of the aluminum alloy, the two portions on the both side faces in the extrusion direction are remained as holding faces for holding by the chuck mechanism at a time of machining, and the other faces on the both side faces are extruded to have concave shapes by removing the upper portion of the other faces. With this extrusion molding, the maximum weight saving of the expansion valve can be attained, while keeping the strength of the surrounding parts of the refrigerant path formed by the machining to the valve main body.

BRIEF EXPLANATION OF DRAWINGS

FIG. 1 (*a*) illustrates a front face view, FIG. 1 (*b*) illustrates a right side face view, and FIG. 1 (*c*) illustrates a back face view.

FIG. 3 (*a*) is a front face view, (*b*) is a right side face view, (*c*) is a back face view, (*d*) is a left side face view, (*e*) is an upper face view, and (*f*) is a lower face view.

FIG. 6 (*a*) is a front face view, (*b*) is a right side face view, (*c*) is a back face view, (*d*) is a left side face view, (*e*) is an upper face view, and (*f*) is a lower face view.

DETAILED DESCRIPTION OF PREFERRED EMBODIMENT

Figure 1A:
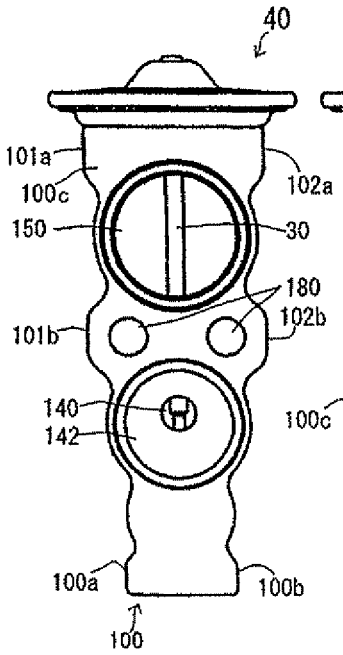
FIG. 1 illustrates one exemplary embodiment of the present invention.
Figure 1B:
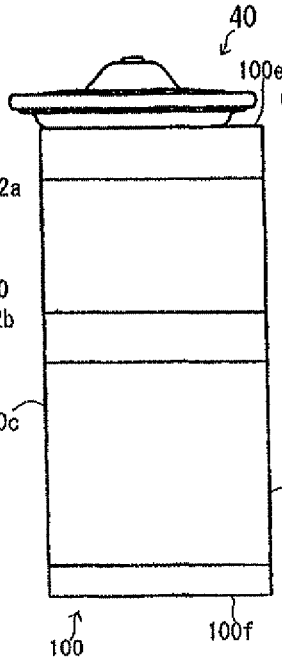
Figure 1C:
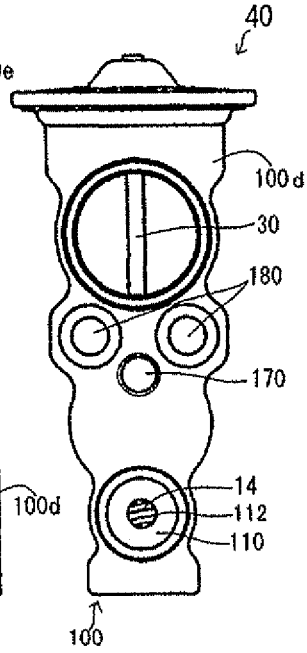

One exemplary embodiment of the present invention will be described with reference to FIGS. 1 to 3. The expansion valve of the present exemplary embodiment includes a valve main body 100 made of an aluminum alloy, and a power element 40 fixed on an upper face 100*e* of the valve main body 100. As illustrated in FIG. 3, the valve main body 100 has two side faces 100*a* and 100*b*, a front face 100*c*, a back face 100*d*, an upper face 100*e*, and a lower face 100*f*, which are formed by an extrusion mold, when the aluminum alloy is cold-extruded. The front face 100*c*, the back face 100*d*, the upper face 100*e*, and lower face 100*f* are orthogonal to the two side faces 100*a* and 100*b*.

Figure 2:
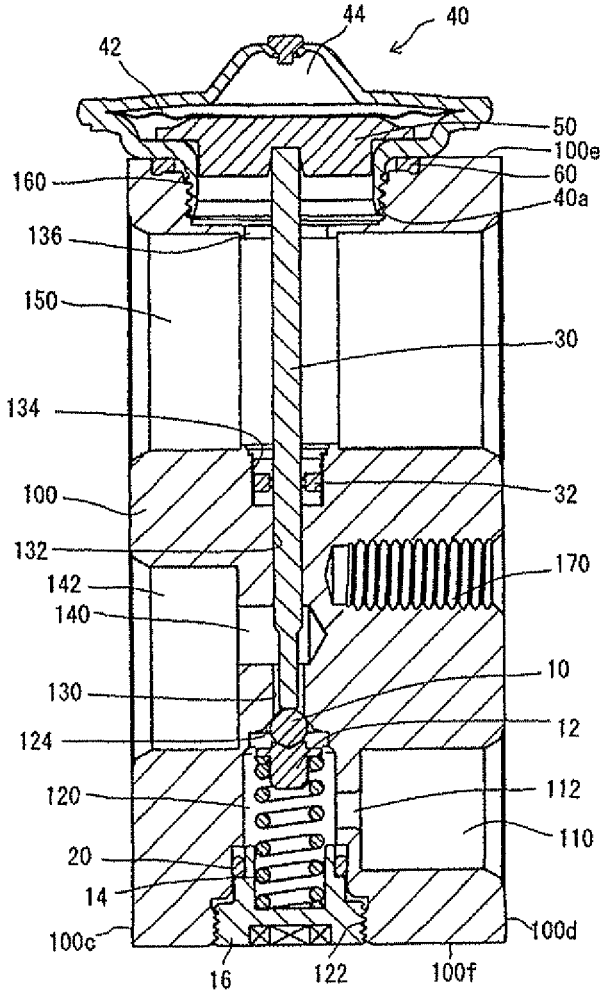
FIG. 2 is a cross-sectional view illustrating the expansion valve of FIG. 1.
Figure 3E:
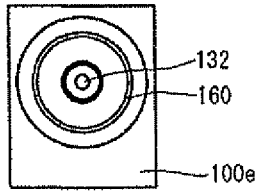
FIG. 3 is a hexahedral view illustrating a valve main body in the expansion valve in FIG. 1.
Figures 3A, 3B, 3C, 3D:
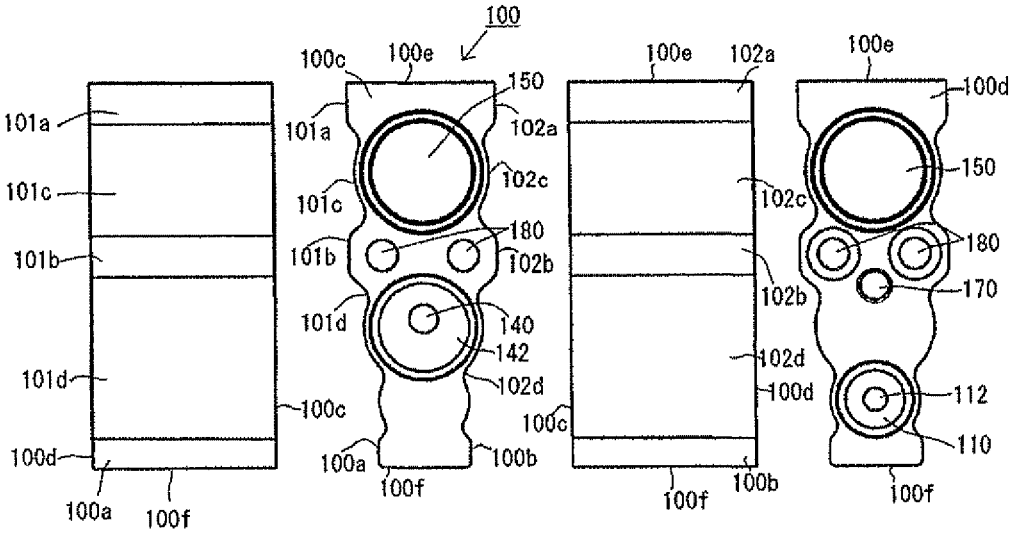
Figure 3F:
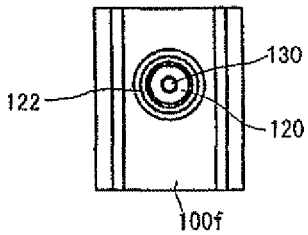

As illustrated in FIG. 2, an inlet passage 110 for introducing a high-pressure liquid refrigerant transmitted from the condenser side is formed near a lower end of the back face 100*d* of the valve main body 100. A small diameter hole 112 is provided at a depth wall and is communicated with a valve chamber 120.

The valve chamber 120 is a round hole in the shape of a multistage column, which is machined from the lower face 100*f* side of the valve main body 100, and a screw 122 to which a plug 16 is screwed is formed at an inner peripheral part of a lower end opening of the valve chamber 120. In the valve chamber 120, a ball-shaped valve body 10 is disposed, and the valve body 10 is supported by the plug 16 via a supporting member 12 and a coil spring 14. An annular seal member 20 is fitted to an upper end outer peripheral part of the plug 16. An orifice 130 is provided at an upper part of the valve chamber 120, and a valve seat 124 with/from which the valve body 10 is brought into contact/separated is formed at a lower end of the valve chamber 120.

A lower end part of a valve rod 30 is in contact with the valve body 10. In the valve main body 100, outlet passages 140 and 142 for refrigerant are formed in parallel with an inlet passage 110 for refrigerant. The outlet passages 140 and 142 are formed by machining from the front face 100*c* side of the valve main body 100.

The inlet passage 110 and the outlet passages 140 and 142 are communicated by the orifice 130. In the orifice 130, the valve rod 30 is inserted, and the valve rod 30 is guided by a guide hole 132 formed on the valve main body 100 to slide. A vibration-proof member 32 is mounted to a hole 134 formed coaxially with the guide hole 132 and prevents vibrations of the valve rod 30 and the valve body 10.

The refrigerant sent from the outlet passage 142 to the evaporator side performs heat exchange with the open air in the evaporator, and returns to the condenser side. At this time, the refrigerant passes through a return passage 150 formed in the valve main body 100. The return passage 150 is a pillar hole penetrating from the front face 100*c* to the back face 100*d* of the valve main body 100.

The valve rod 30 penetrates the return passage 150 in the diameter direction and projects toward the upper face 100*e* side of the valve main body 100. A screw hole 160 for fixing the power element 40 is formed on the upper face 100*e* side of the valve main body 100. In the power element 40 to be screwed to the screw hole 160, the inside is divided into upper and lower chambers by a diaphragm 42, and the upper chamber is a gas chamber 44 for enclosing a heatsensitive gas for driving a diaphragm. A stopper member 50 is disposed on a lower face of the diaphragm 42. The stopper member 50 transmits displacement of the diaphragm 42 to the valve rod 30 and drives the valve body 10.

The screw hole 160 communicates with the return passage 150 via an opening 136, and the temperature and the pressure of the refrigerant passing through the return passage 150 are transmitted to the lower face of the diaphragm 42. An annular seal member 60 is disposed between the upper face 100*e* of the valve main body 100 and the power element 40.

At a center part of the back face 100*d* of the valve main body 100, one bottomed screw hole 170 is formed. On both sides of the screw hole 170, two attaching holes 180 penetrating from the front face 100*c* to the back face 100*d* of the valve main body 100 are formed.

In the valve main body 100 of the present exemplary embodiment, two flat holding faces 101*a* and 101*b*, which form the outer most face among faces forming the left side face 100*a* of the valve main body 100 are remained, and other faces are shaped to be concave more on the inner side than the holding faces 101*a* and 101*b*.

The concave part 101*c* between the holding faces 101*a* and 101*b* is formed to have a waved cross section so as to be as thin as possible along the inner peripheral face of the return passage 150. The concave part 101*d* more on the lower side than the holding face 101*b* is formed to have a waved cross section so as to be as thin as possible along the inner peripheral faces of the outlet passage 142 and the inlet passage 110.

The holding face 101*a* is formed between the return passage 150 and the upper face 100*e* of the valve main body 100 to which the power element 40 is mounted. The holding face 101*b* is formed at a near center part between the upper face 100*e* and the lower face 100*f* of the valve main body 100. As described below, the two holding faces 101*a* and 101*b* are formed to have a width dimension proper for holding by a chuck claw when machining the valve main body 100. Similarly, two holding faces 102*a* and 102*b*, and thin concave parts 102*c* and 102*d* are formed on the right side face 100*b* of the valve main body 100. These holding faces 102*a* and 102*b* and the concave parts 102*c* and 102*d* are formed symmetrically to the left side.

Figure 4:
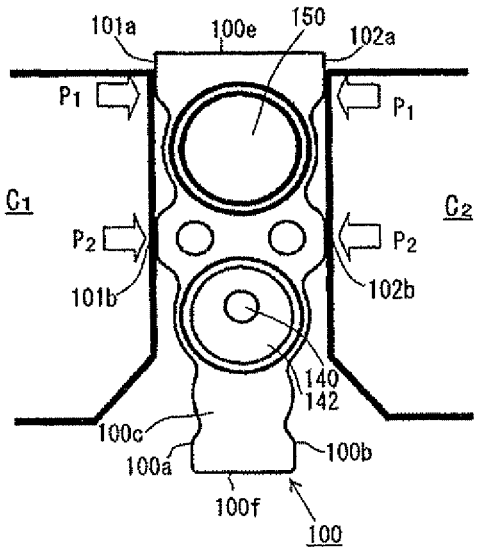
FIG. 4 is a view illustrating a state that the valve main body in FIG. 3 is held by a chuck mechanism.

FIG. 4 illustrates a state that the front face 100*c* and the upper face 100*e* of the valve main body 100 are machined while holding the valve main body 100 with chuck claws $C_1$ and $C_2$ of a machine tool. The chuck claws $C_1$ and $C_2$ hold the left side face 100*a* and the right side face 100*b* of the valve main body 100 in the direction orthogonal to the extruding direction. As mentioned above, the holding faces 101*a* and 101*b* are formed on the left side face 100*a*, and the holding faces 102*a* and 102*b* are formed on the right side face 100*b*. In addition, the holding faces 101*a* and 102*a* are mutually parallel, and the holding faces 101*b* and 102*b* are mutually parallel. Thus, the chuck claws $C_1$ and $C_2$ can certainly hold the valve main body 100.

In the state of holding the valve main body 100, the outlet passages 140 and 142 and the return passage 150 are machined from the front face 100*c* side to the back face 100*d* side of the valve main body 100. Further, the screw hole 160 for attaching the power element 40, and the guide hole 132 of the valve rod 30 are machined from the upper face 100*e* side. The chuck claws $C_1$ and $C_2$ applies appropriate pressures $P_1$ and $P_2$ to the holding faces 101*a* and 102*a* and the holding faces 101*b* and 102*b*, which are opposed each other, so that these faces can certainly receive stress generating at the valve main body 100 when machining. The width dimensions of the holding faces 101*a* and 102*a* and the holding faces 101*b* and 102*b* are set to be appropriate dimensions, which do not generate unnecessary stress and can apply necessary friction force to hold the valve main body 100, when the pressure $P_1$ and $P_2$ are applied.

Figure 5:
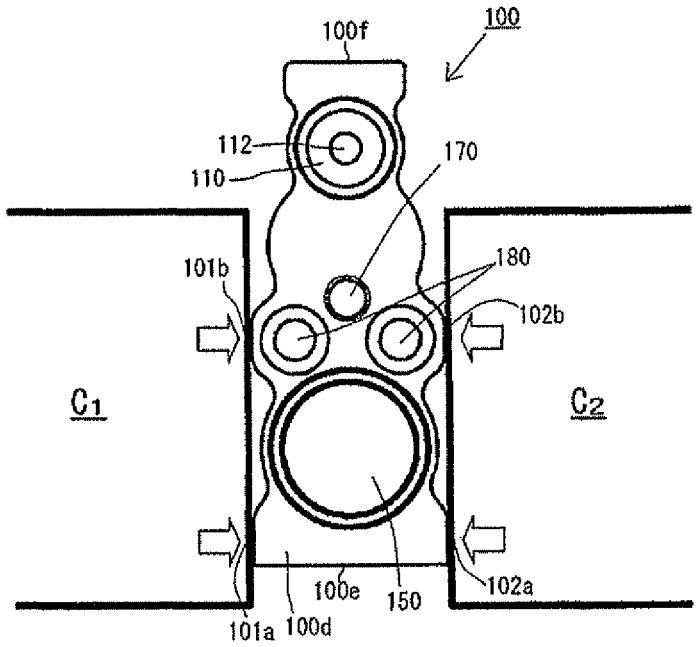
FIG. 5 is a view illustrating a state that the valve main body in FIG. 3 is held by a chuck mechanism.

FIG. 5 illustrates a state of reversing the valve main body 100 up and down and holding it. In this state, the valve main body 100 is machined from the back face 100*d* side thereof. The parts to be machined are the inlet passage 110 for refrigerant, the small diameter hole 112, the return passage 150, the bottomed screw hole 170, and the penetration hole 180 in which a bolt for attachment is inserted. Furthermore, in this state, the valve chamber 120, the orifice 130 are machined from the lower face 100*f* side.

Figure 6E:
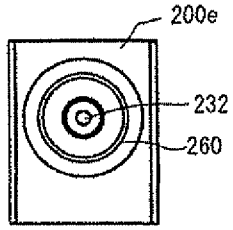
FIG. 6 is a hexahedral view of another exemplary embodiment.
Figures 6A, 6B, 6C, 6D:
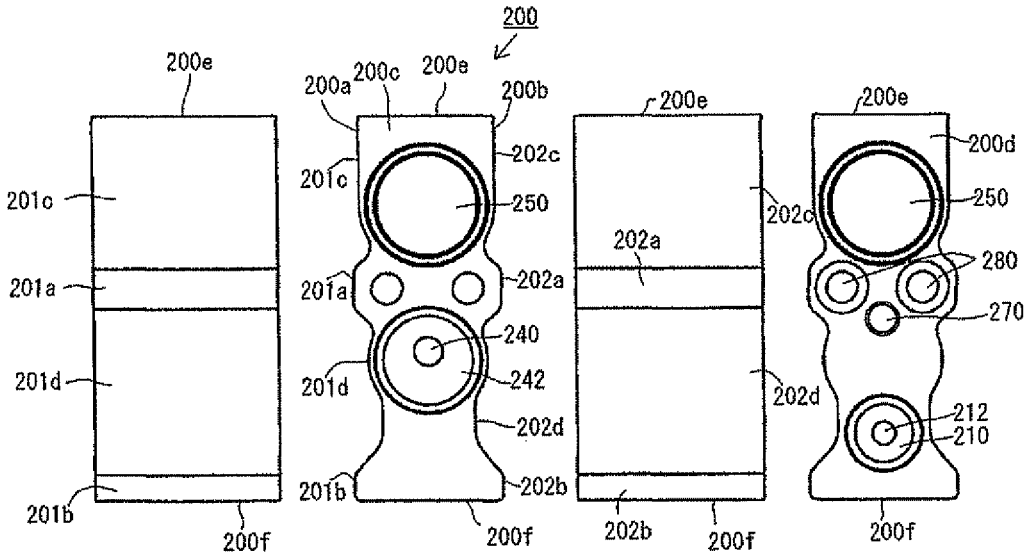
Figure 6F:
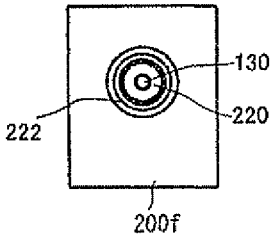

Then, another exemplary embodiment of the present invention will be described with reference to FIG. 6. In addition, a cross-sectional shape of the present exemplary embodiment is the same as that in FIG. 2.

Similarly to the valve main body 100 mentioned above, a valve main body in which the entirety is noted by the code number 200 has a hexahedral structure including a left side face 200*a*, a right side face 200*b*, a front face 200*c*, a back face 200*d*, an upper face 200*e*, and a lower face 200*f*. A small diameter hole 212 communicating with an inlet passage 210 of refrigerant and a valve chamber 220 is provided on the lower end side of the back face 200*d* of the valve main body 200. Outlet passages 240 and 242 for discharging refrigerant toward the evaporator side are provided at the front face 200*c* of the valve main body 200. From the upper face 200*e* side of the valve main body, a screw hole 260 for attaching a power element, a guide hole 232 of a valve rod provided coaxially with the screw hole 260 are machined.

A return passage 250 for refrigerant, which penetrates from the front face 200*c* to the back face 200*d*, is formed near the upper face 200*e* of the valve main body 200. From the back face 200*d* side, a bottomed screw hole 270 and a through hole 280 for an attaching bolt are machined. A material of the valve main body 200 is produced by a cold-extrusion molding of an aluminum alloy in the direction orthogonal to the front face 200*c* and the back face 200*d*. It is not necessary to machine the both side faces 200*a* and 200*b* of the valve main body 200.

In the extrusion molding, holding faces 201*a* and 202*a* are formed at a nearly center part in the upper and lower directions of the both side faces 200*a* and 200*b*, and holding faces 201*b* and 202*b* are formed at lower end parts. The other portions of the both side faces 200*a* and 200*b* are formed in a concave shape, which is concave more on the inner side than the holding faces 201*a* and 202*a* and the holding faces 201*b* and 202*b*.

Figure 7:
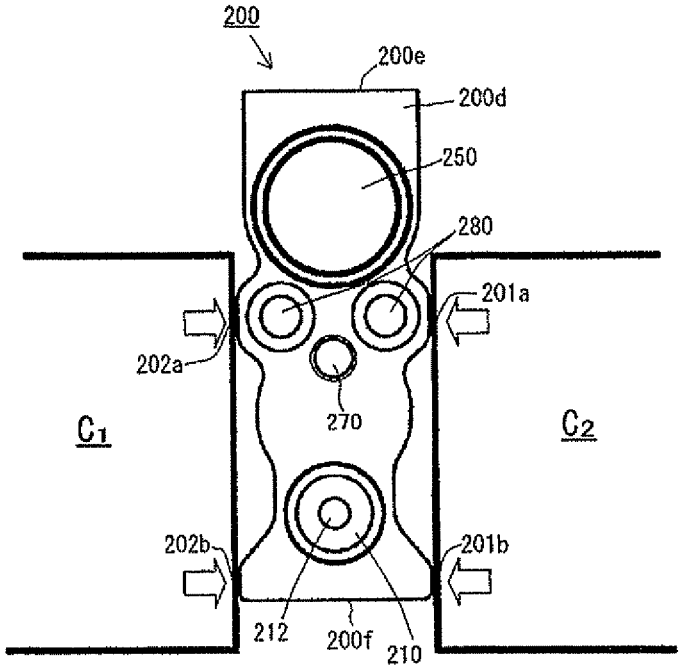
FIG. 7 is a view illustrating a state that the valve main body in FIG. 6 is held by a chuck mechanism.

FIG. 7 illustrates a state that the valve main body 200 is chucked by a machine tool. Chuck claws $C_1$ and $C_2$ hold the two pair of holding faces 201*a* and 202*a*, and 201*b* and 202*b* of the valve main body 200, which are opposed each other. While keeping this state, the inlet passages 210 and 212 for refrigerant, the return passage 250 for refrigerant, the bottomed screw hole 270, the two through holes 280 for the attaching bolts, and the like are machined from the back face 200*d* side of the valve main body 200. Further, from the upper face 200*e* side, portions necessary for machining, such as the screw hole 260 for attaching the power element, the guide hole 232 of the valve rod, and the like are machined.

Figure 8:
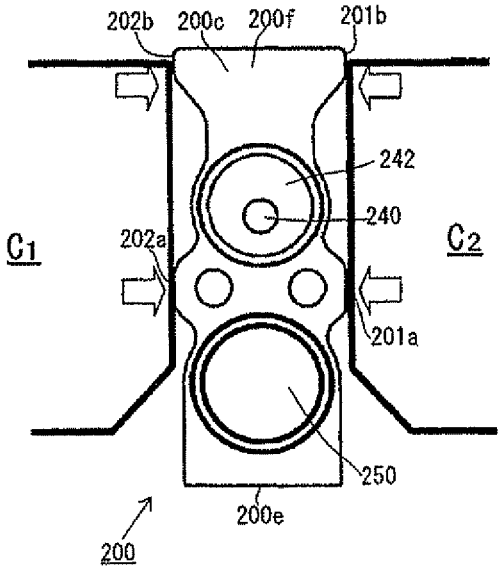
FIG. 8 is a view illustrating a state that the valve main body in FIG. 6 is held by a chuck mechanism.

FIG. 8 illustrates a state that the valve main body 200 is rotated up and down and held by the chuck claws $C_1$ and $C_2$. In this state, portions necessary for machining, such as the outlet passages 240, 242 and the like are machined from the front face 200*c* side of the valve main body. In this state, a valve chamber 220 and a screw hole 222 for screwing a plug for sealing the valve chamber 220 are machined from the lower face 200*f* side.

As described above, in the valve main body of the expansion valve of the present invention, it is noted that a material is produced by the extrusion molding of an aluminum alloy, or the like. It is also noted that side faces, which are opposed each other and pass through a face of a metal mold at a time of the extrusion molding, do not need to be machined in the subsequent processing. Then, two holding faces held by chuck claws at a time of machining are remained on the both side faces, and the other faces are formed in a concave shape. As a result, the expansion valve of the present invention can attain to reduce in the weight as lower as possible.

In addition, in the aforementioned exemplary embodiments, an expansion valve having a structure that a plug for sealing a valve chamber is mounted to a lower face of the valve main body is described as an example. However, the present invention can be applied to a un-adjustment type expansion valve not including a plug.

Furthermore, the aforementioned exemplary embodiments can be variously changed within a range not straying from the objective of the present invention.

What is claimed is:

1. An expansion valve comprising:

a valve main body having a first passage in which a high-pressure refrigerant goes from a condenser to an evaporator, an orifice provided at the middle of the first passage and for reducing pressure of the high-pressure refrigerant, and a second passage in which a low-pressure refrigerant goes from the evaporator to the condenser;

a valve body for opening/closing the orifice; and a power element for driving the valve body based on a temperature and pressure on an outlet side of the evaporator, wherein the valve main body is formed by an extrusion molding, wherein, in a state that both side faces in an extruding direction of the valve main body are held in the direction orthogonal to the extruding direction by a chuck mechanism, a face intersecting the both side faces is machined, so that the first passage, the second passage, the orifice and attaching hole of the power element are formed, wherein the both side faces has a pair of flat holding faces held by the chuck mechanism that are coplanar or located on substantially the same plane, such that each pair of flat holding faces form the outermost face on the respective side faces, wherein the pairs of flat holding faces on both side faces are parallel with each other, wherein portions other than the holding faces are formed on the respective side faces, or areas of the respective side faces, to have concave parts which are concave more on an inner side than the holding faces, and wherein the holding faces and the concave parts are formed at a time of an extrusion molding.

2. The expansion valve according to claim 1, wherein concave parts along a peripheral face of the second passage are formed on both sides in the axial direction of the second passage, and wherein a pair of the holding faces is formed on the upper and lower sides of the concave part on a respective side face.

3. The expansion valve according to claim 1, wherein concave parts along a peripheral face of the first passage are formed on both sides in the axial direction of the first passage, and wherein a pair of the holding faces is formed on the upper and lower sides of the concave part on a respective side face.

* * * * *